US011189437B2

(12) United States Patent
Blatz et al.

(10) Patent No.: US 11,189,437 B2
(45) Date of Patent: Nov. 30, 2021

(54) SWITCH DEVICE FOR A POWER TOOL

(71) Applicant: Hilti Aktiengesellschaft, Schaan (LI)

(72) Inventors: Thomas Blatz, Kaufering (DE); Lionel Barbier, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 38 days.

(21) Appl. No.: 16/345,572

(22) PCT Filed: Oct. 25, 2017

(86) PCT No.: PCT/EP2017/077273

§ 371 (c)(1),
(2) Date: Apr. 26, 2019

(87) PCT Pub. No.: WO2018/077929

PCT Pub. Date: May 3, 2018

(65) Prior Publication Data

US 2019/0252133 A1 Aug. 15, 2019

(30) Foreign Application Priority Data

Oct. 27, 2016 (EP) ..... 16195891

(51) Int. Cl.
*H01H 9/06* (2006.01)
*B25F 5/02* (2006.01)
(Continued)

(52) U.S. Cl.
CPC ..... *H01H 9/06* (2013.01); *B24B 23/00* (2013.01); *B25F 5/02* (2013.01); *H01H 3/20* (2013.01);
(Continued)

(58) Field of Classification Search
CPC ..... H01H 9/06; H01H 3/20; H01H 9/161; H01H 13/83; H01H 2300/024; H01H 9/16;
(Continued)

(56) References Cited

U.S. PATENT DOCUMENTS 7,507,925 B2 * 3/2009 Rudolf ..... H01H 9/06 200/302.2
8,160,657 B2 * 4/2012 Perriello ..... H04M 1/23 455/575.1
(Continued)

FOREIGN PATENT DOCUMENTS

CN 103372682 A 10/2013
CN 104953497 9/2015
(Continued)

OTHER PUBLICATIONS

International Search Report of PCT/EP2017/077273, dated May 2, 2018.

*Primary Examiner* — Lheiren Mae A Caroc
(74) *Attorney, Agent, or Firm* — Davidson, Davidson & Kappel, LLC

(57) ABSTRACT

An operating device (1) for a power tool, including at least one first and second switching element (40, 50), the first switching element (40) being settable to a first and a second mode, and the second switching element (50) being settable to a first and a second mode, the first switching element (40) including at least one first signaling means (21) for the particular signaling of the first or second mode, and the second switching element (50) including at least one second signaling means (22) for the particular signaling of the first or second mode. The operating device is designed in such a way that the second switching element (50) is settable from the first mode to the second mode only when the first switching element (40) is set from the first mode to the second mode.

10 Claims, 3 Drawing Sheets

(51) Int. Cl.
*B24B 23/00* (2006.01)
*H01H 3/20* (2006.01)
*H01H 9/16* (2006.01)
*H01H 13/83* (2006.01)

(52) U.S. Cl.
CPC ..... *H01H 9/161* (2013.01); *H01H 13/83* (2013.01); *H01H 2300/024* (2013.01)

(58) Field of Classification Search
CPC ..... B25F 5/02; B24B 23/00; B25D 16/006; B25D 2250/255; B25D 2216/0084
USPC ..... 200/332.3, 43.17, 61.85, 522
See application file for complete search history.

(56) References Cited

U.S. PATENT DOCUMENTS 8,253,046 B2 * 8/2012 Chen ..... H01H 13/83 200/5 A
8,919,456 B2 * 12/2014 Ng ..... G05B 15/02 173/11
9,782,884 B2 10/2017 Ota et al.
2003/0069576 A1 * 4/2003 Tanrisever ..... H05H 1/48 606/41
2005/0136814 A1 6/2005 Rudolf et al.
2013/0105187 A1 * 5/2013 Agehara ..... B25B 21/02 173/20
2013/0277081 A1 10/2013 Hayashi et al.
2014/0190713 A1 7/2014 Martinsson et al.
2017/0334053 A1 11/2017 Boeck et al.

FOREIGN PATENT DOCUMENTS

DE 20 2015 007 933 U1 12/2015
DE 102015214388 A1 6/2016
EP 1563962 A1 8/2005
JP H0533427 U 4/1993
JP H07326251 A 12/1995
JP H1139990 A 2/1999
JP 2016028846 A 3/2016
JP 2016096805 A 5/2016
JP 2016097494 A 5/2016
JP 2016101646 A 6/2016
WO WO2009/030541 A1 3/2009
WO WO2013032374 A1 3/2013

* cited by examiner

SWITCH DEVICE FOR A POWER TOOL

The present invention relates to an operating device for a power tool, in particular a grinder, including at least one first and one second switching element, the first switching element being settable to a first and a second mode, and the second switching element being settable to a first and a second mode, the first switching element including at least one first signaling means for the particular signaling of the first or second mode, and the second switching element including at least one second signaling means for the particular signaling of the first or second mode.

BACKGROUND

The On/Off switch (also referred to as operating device) on hand-guided power tools generally requires two independent actuations to activate the power tool. A safety feature of this type is required, in particular in grinding and cutting devices.

This requirement is usually met by combined mechanical switches, which must be first pushed in a first direction and subsequently moved in a second direction to turn on the power tool. To implement a mechanism of this type on these switches, comparatively complex coupling drives or slide guides are usually necessary in the switches.

The switches or operating devices of power tools according to the prior art are usually extremely complex and costly to manufacture.

SUMMARY OF THE INVENTION

It is an object of the present invention to provide an improved operating device for a power tool.

The present invention provides an operating device for a power tool, in particular a grinder, including at least one first and one second switching element, the first switching element being settable to a first and a second mode, and the second switching element being settable to a first and a second mode, the first switching element including at least one first signaling means for the particular signaling of the first or second mode, and the second switching element including at least one second signaling means for the particular signaling of the first or second mode.

According to the present invention, the operating device is designed in such a way that the second switching element is settable from the first mode to the second mode only if the first switching element is set from the first mode to the second mode. This makes it possible to effectively prevent the second mode of the second switching element from being accidentally or unintentionally activated by the user without first moving the first switching element from the first mode to the second mode. An unintentional or inadvertent mode, e.g. turning on the power tool, may be prevented in this way, and the safety in handling a power tool may be enhanced.

The first and second signaling means may be exclusively a visual signaling means, i.e. a lamp, or exclusively an acoustic signaling means. Alternatively, both the first and the second signaling means may be formed by a visual and acoustic signaling means. Moreover, it is also possible that the first signaling means is a visual signaling means and the second signaling means is an acoustic signaling means. It is also possible that the second signaling means is a visual signaling means and the first signaling means is an acoustic signaling means. The visual or acoustic signaling means may be designed in such a way that either a continuous or a sustained signal (i.e. continuous light) or an interrupted signal (i.e. flashing) is emitted.

According to one advantageous specific embodiment of the present invention, it may be possible that an elastomer attachment having a first and a second elevation and a membrane keypad having at least one first and second membrane key is included, the elastomer attachment is positioned over the membrane keypad in a first direction, so that the first membrane key may be activated by a predetermined pressure force on the first elevation in a second direction, and the second membrane key may be activated thereby on the second elevation. A simple and cost-effective operating device may be designed hereby, which simultaneously has a resistance to moisture (e.g. water) penetrating the operating device. In an alternative specific embodiment, a circuit board having micro pushbuttons may be used instead of the membrane keypad.

According to another advantageous specific embodiment, it may be provided that the elastomer attachment has an edge area, which has an elevation extending around the outer contour of the elastomer attachment in one direction to generate a sealing effect, in particular for the membrane keypad, in the assembled state of the operating device. An integrated seal on the elastomer attachment is conveniently established hereby. An additional seal may thus be avoided. The elevation extending around the outer contour of the elastomer attachment may also be referred to as a bulge or edge. In particular, the seal is intended to counteract penetrating moisture.

According to another advantageous specific embodiment of the present invention, it may be possible that the first switching element is implemented by the first elevation on the elastomer attachment and the first membrane key, and the second switching element is implemented by the second elevation on the elastomer attachment and the second membrane key, a housing of the power tool having at least one first and second opening, and the elastomer attachment being positioned with respect to the first and second openings of the housing in such a way that the first elevation may be operated through the first opening, and the second elevation may be operated through the second opening.

According to one advantageous specific embodiment of the present invention, it may be possible that the first and second elevations each include at least one projecting element, and the first and second openings each include at least one recess, the at least one projecting element being positioned in the at least one recess in the assembled state of the operating device, so that a complete passage of the first or second elevation through the first or second opening in each case is prevented. This may prevent an elevation which becomes detached from the elastomer attachment from falling through the opening and becoming lost. A detachment of an elevation from the elastomer attachment may be a result of an excessive use.

According to another advantageous specific embodiment of the present invention, it may be possible that the first mode of the first switching element corresponds to a blocking function, and the second mode of the first switching element corresponds to a release function, the first mode of the second switching element corresponding to an idle function, and the second mode of the second switching element corresponding to a working function. This ensures that an uncontrolled activation of the power tool is prevented if only one switching element is actuated.

According to one advantageous specific embodiment of the present invention, it may be possible that the first switching element is settable from the first mode to the second mode only when the first switching element is actuated for longer than a predetermined period of time. This may ensure that the first switching element does not unintentionally change from the first mode to the second mode when the first switching element is actuated for less than a predetermined period of time. Actuating the first switching element for longer than a predetermined period of time may indicate to the power tool that the user is actuating the first switching element intentionally and also intends to change from the first mode to the second mode.

According to one advantageous specific embodiment of the present invention, it may furthermore be possible that the first switching element is set from the second mode back to the first mode when the second switching element is actuated only after a predetermined period of time has elapsed. This may ensure that the first switching element does not remain continuously in the second mode and thus allow the second switching element, and thus the power tool, to be activated or adjusted to the second mode upon careless handling by a user.

According to another advantageous specific embodiment of the present invention, it may be possible that the first signaling means indicates the first mode of the first switching element when the second switching element is actuated. This makes it possible to easily indicate to the user that, for a mode change (i.e. from the first mode to the second mode) of the second switching element, the first switching element must be placed beforehand from the first mode into the second mode.

According to one advantageous specific embodiment of the present invention, it may be possible that the first signaling means indicates the second mode of the first switching element when the first switching element is actuated for longer than a predetermined period of time. The fact that the first switching element was actuated long enough, and the second mode is now set for the first switching element may be thereby easily indicated to the user of the power tool.

According to another advantageous specific embodiment of the present invention, it may be possible that the second signaling means indicates the first mode of the second switching element when the first switching element is in the second mode. The fact that the second switching element is now ready to be set from the first mode to the second mode may be thereby easily indicated to the user of the power tool.

Other advantages result from the following description of the figures. The figures illustrate different exemplary embodiments of the present invention. The figures, the description and the claims contain numerous features in combination. Those skilled in the art will advantageously also consider the features individually and combine them to form other meaningful combinations.

BRIEF DESCRIPTION OF THE DRAWINGS

In the figures, identical and equivalent components are provided with identical reference numerals.

DETAILED DESCRIPTION

Figure 1:
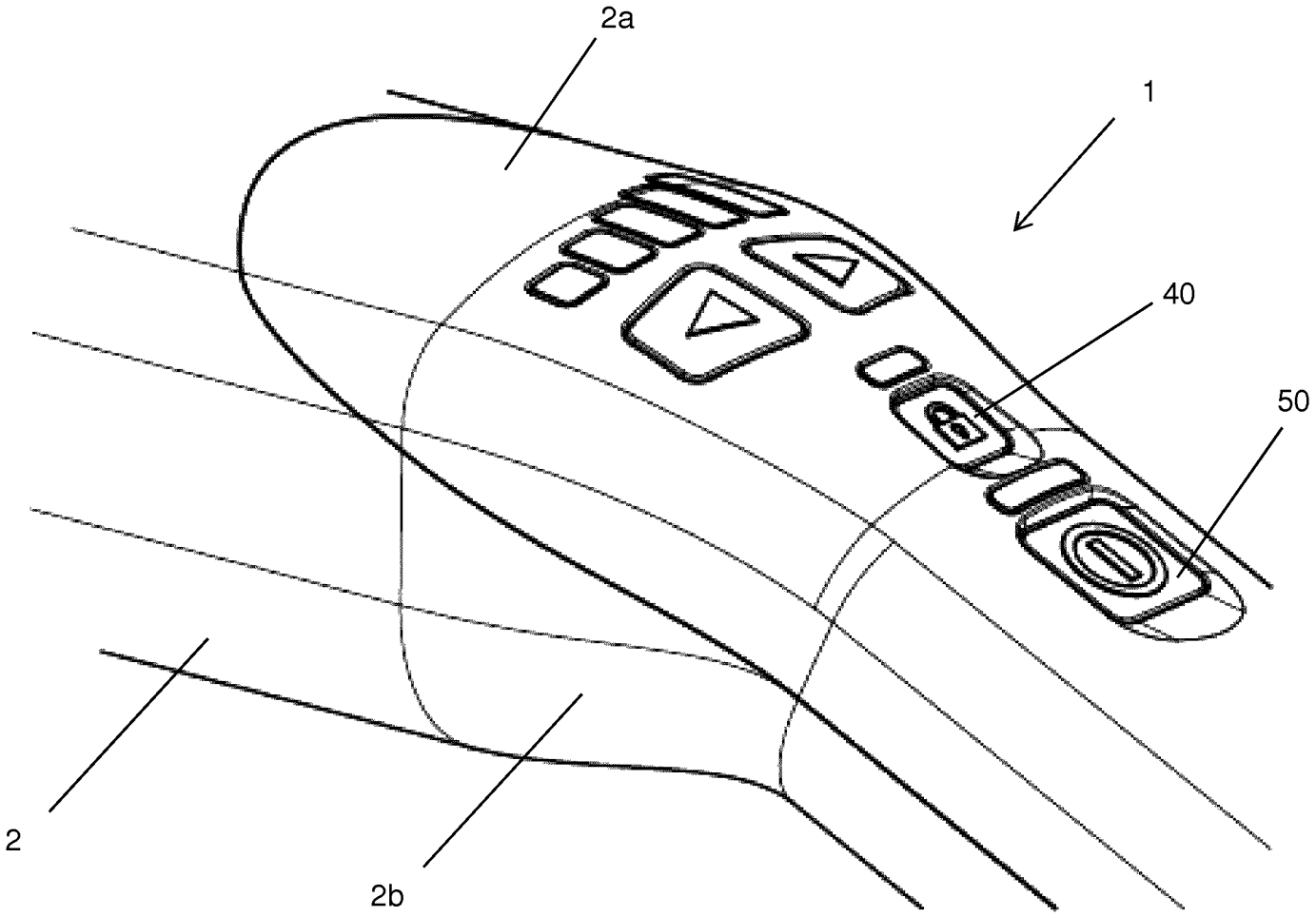
FIG. 1 shows a perspective view of an operating device on a housing of a power tool according to one specific embodiment of the present invention.

FIG. 1 shows an operating device 1 for a power tool, in particular a grinder. However, the power tool may also be any other suitable power tool. The power tool is not illustrated in full in the figures. Only one part of housing 2 of the power tool is illustrated in the figures.

Operating device 1 essentially includes an elastomer attachment 3 and a membrane keypad 4.

Figure 2:
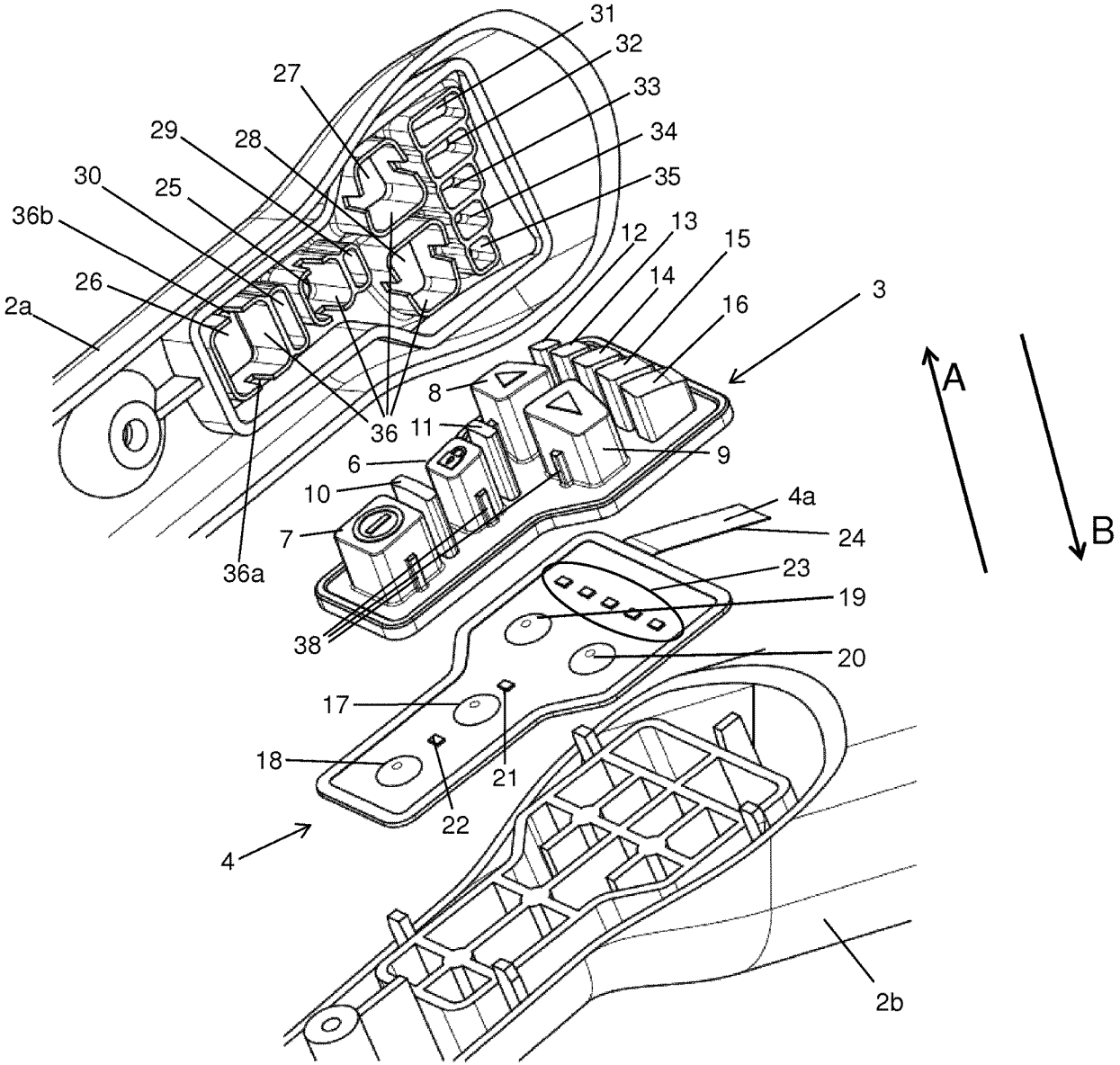
FIG. 2 shows a perspective view of the operating device, including an elastomer attachment and a membrane keypad in a disassembled state.
Figures 3A, 3B:
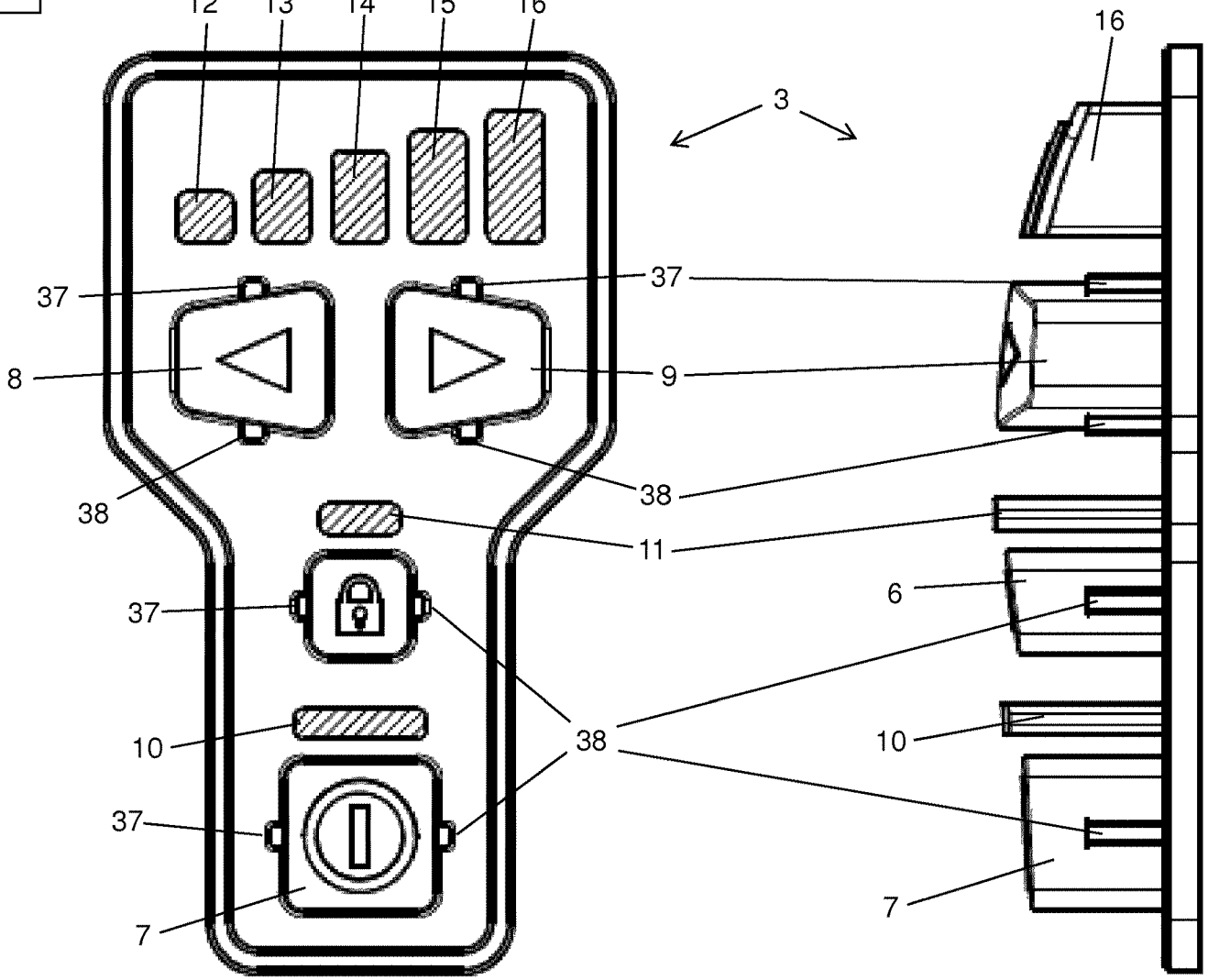
FIG. 3*a* shows a top view of the elastomer attachment.
FIG. 3*b* shows a side view of the elastomer attachment.

Elastomer attachment 3, in turn, essentially includes a baseplate 5 and a number of elevations (cf. FIGS. 2 and 3). Elastomer attachment 3 is manufactured from a soft, flexible plastic. The plastic may be silicone or the like. As illustrated in FIG. 2, elastomer attachment 3 includes a first, second, third, fourth, fifth, sixth, seventh, eighth, ninth, tenth and eleventh elevation 6, 7, 8, 9, 10, 11, 12, 13, 14, 15, 16. First, second, third and fourth elevations 6, 7, 8, 9 each have a cylindrical and solid design and are each used as an actuating element. Fifth through eleventh elevations 10, 11, 12, 13, 14, 15, 16 are used as indicator elements.

Elastomer attachment 3 may optionally also be provided with a hard cap in the area of the actuating elements.

Membrane keypad 4 essentially includes a first, second, third and fourth membrane key 17, 18, 19, 20 as well as a first and second signaling means 21, 22. A light scale having five light levels 23 is furthermore included on membrane keypad 4. Signaling means 21, 22, 23 are each designed in the form of an LED (light-emitting diode). At one end 4*a*, membrane keypad 4 has a flat ribbon cable 24 as an electrical connection.

The power tool includes a housing 2, which essentially has a first and a second housing half 2*a*, 2*b*. Elastomer attachment 3 as well as membrane keypad 4 are positioned and held between first and second housing halves 2*a*, 2*b* in an assembled state. As illustrated in FIG. 2, first housing half 2*a* has eleven openings 25, 26, 27, 28, 29, 30, 31, 32, 33, 34, 35. Eleven openings 25, 26, 27, 28, 29, 30, 31, 32, 33, 34, 35 in first housing half 2*a* are used to accommodate eleven elevations 6, 7, 8, 9, 10, 11, 12, 13, 14, 15, 16 of elastomer attachment 3, so that a user activates elevations 6, 7, 8, 9 designed as actuating elements through the openings. As also illustrated in FIG. 2, first, second, third and fourth openings 25, 26, 27, 28 of first housing half 2*a* have a border 36. Each border 36 has a first and a second recess 36*a*, 36*b*. However, each recess 36*a*, 36*b* does not extend over the entire height of border 36, so that recess 36*a*, 36*b* is essentially designed as a slit or notch in border 36. First, second, third and fourth elevations 6, 7, 8, 9 each include a first and second projecting element 37, 38. First projecting element 37 of elevation 6, 7, 8, 9 is designed in such a way that it may be inserted into particular first recess 36*a*, 36*b* of opening 25, 26, 27, 28. Second projecting element 36*a*, 36*b* of recess 6, 7, 8, 9 is furthermore designed in such a way that it may be inserted into particular second recess 36*b* of opening 25, 26, 27, 28. When elevations 6, 7, 8, 9, 10, 11, 12, 13, 14, 15, 16 of elastomer attachment 3 are accommodated in particular openings 25, 26, 27, 28, 29, 30, 31, 32, 33, 34, 35 of first housing half 2*a*, projecting elements 37, 38 are inserted into particular recesses 36*a*, 36*b*. The interaction of projecting elements 37, 38 with recesses 36*a*, 36*b* prevents an elevation 6, 7, 8, 9, which has become detached from baseplate 5 of elastomer attachment 3, from falling through opening 25, 26, 27, 28. Even an elevation 6, 7, 8, 9 detached from baseplate 5 remains held thereby in opening 25, 26, 27, 28 of first housing half 2*a* and is thus still able to function. A detachment of an elevation 6, 7, 8, 9 from baseplate 5 may take place due to wear.

As mentioned above, elastomer attachment 3 as well as membrane keypad 4 are situated between first and second housing halves 2*a*, 2*b* in an assembled state. First and second housing halves 2*a*, 2*b* are detachably connected to each other by a screw connection. The elastomer attachment is situated over membrane keypad 4 in a first direction A. It should be noted that elastomer attachment 3 is arranged or positioned over membrane keypad 4 in such a way that elevations 6, 7, 8, 9 designed as actuating elements (first, second, third and fourth elevations) are each positioned accordingly above first, second, third and fourth membrane keys 17, 18, 19, 20 in direction A. When the user of the power tool applies a certain pressure to elevations 6, 7, 8, 9 designed as actuating elements, membrane keys 6, 7, 8, 9 situated below elastomer attachment 3 in second direction B may be activated hereby. Moreover, fifth through eleventh elevations 10, 11, 12, 13, 14, 15, 16 designed as indicator elements are situated over the signaling means of membrane keypad 4 in the assembled state. The material of elastomer attachment 3 is translucent. However, the upper surface of elevation 10, 11, 12, 13, 14, 15, 16 has an opaque coating. In the indication areas of fifth through eleventh elevation 10, 11, 12, 13, 14, 15, 16, the coating is removed, so that the light of the underlying signaling means may shine through. This allows the user of the power tool to perceive an illumination of the signaling means on the outside of housing 2 of the power tool.

A combination of an elevation 6, 7, 8, 9 designed as an actuating element (i.e. the first through fourth elevation) with one of first through fourth membrane keys 17, 18, 19, 20 is used as a switching element. First switching element 40 therefore includes first elevation 6 designed as an actuating element as well as first membrane key 17. In addition, second switching element 50 includes second elevation 7 designed as an actuating element as well as second membrane key 18.

To activate the power tool, first switching element 40 (i.e. the combination of first elevation 6 and first membrane key 17) is initially pressed in second direction B for a certain first period of time (approximately 10 to 20 milliseconds). In addition, first signaling means 21 lights up multiple times, i.e. flashes, when second switching element 50 is pressed, without first switching element 40 first being pressed for longer than the predetermined first period of time. This function is used to indicate to the user of the power tool that first switching element 40 must initially be pressed for the first period of time to activate the power tool. After first switching element 40 has been pressed for longer than the predetermined first period of time, first signaling means 21 goes out and second signaling means 22 lights up for a predetermined second period of time (approximately 3 to 5 seconds). While second signaling means 22 lights up for the second period of time, second switching element 50 (i.e. the combination of second elevation 7 and second membrane key 18) may be pressed in second direction B. The power tool is finally activated by the pressing and actuation of second switching element 50, i.e. an electric motor in the power tool is turned on. The electric motor is not illustrated in the figures. However, if second switching element 50 is not pressed within the second period of time, second signaling means 22 goes out, while first signaling means 21 lights up again, and a pressing of second switching element 50 no longer results in an activation of the power tool.

To terminate the activation of the power tool or the electric motor, second switching element 50 is pressed again.

First switching element 40 is used as a locking key, and second switching element 50 is used as the actual activating key (On/Off key).

The invention claimed is:

1. An operating device for a power tool, the operating device comprising:

at least one first and second switching element, the first switching element being settable to a first and a second mode of the first switching element, and the second switching element being settable to a first and a second mode of the second switching element, the first switching element including at least one first signal means for particular signaling of the first or second mode of the first switching element, and the second switching element including at least one second signal means for particular signaling of the first or second mode of the second switching element, the second switching element being settable from the first mode to the second mode of the second switching element only when the first switching element is set from the first mode to the second mode of the first switching element;

wherein the second signal means indicates the first mode of the second switching element when the first switching element is in the second mode.

2. The operating device as recited in claim 1 further comprising an elastomer attachment having a first and a second elevation and a membrane keypad having at least one first and second membrane key, the elastomer attachment being positioned over the membrane keypad in a first direction A, so that the first membrane key is activatable by a predetermined pressure force on the first elevation in a second direction B, and the second membrane key is activatable by a second predetermined pressure force on the second elevation.

3. The operating device as recited in claim 2 wherein the first switching element is implemented by the first elevation on the elastomer attachment and the first membrane key, and the second switching element is implemented by the second elevation on the elastomer attachment and the second membrane key, a housing of the power tool having at least one first and second opening, and the elastomer attachment being positioned with respect to the first and second openings of the housing in such a way that the first elevation is operatable through the first opening, and the second elevation is operatable through the second opening.

4. The operating device as recited in claim 3 wherein the first and second elevations each include at least one projecting element, and the first and second openings each have at least one recess, each of the at least one projecting element being positioned in a respective at least one recess in an assembled state of the operating device, so that a complete passage of the first or second elevation through the first or second opening is prevented.

5. The operating device as recited in claim 1 wherein the first mode of the first switching element corresponds to a blocking function, and the second mode of the first switching element corresponds to a release function, and the first mode of the second switching element corresponds to an idle function, and the second mode of the second switching element corresponds to a working function.

6. The operating device as recited in claim 1 wherein the first signal means indicates the first mode of the first switching element when the second switching element is actuated.

7. The operating device as recited in claim 1 wherein the first signal means indicates the second mode of the first switching element when the first switching element is actuated for longer than a predetermined period of time.

8. A grinder comprising the operating device as recited in claim 1.

9. An operating device for a power tool, the operating device comprising:

at least one first and second switching element, the first switching element being settable to a first and a second mode of the first switching element, and the second switching element being settable to a first and a second mode of the second switching element, the first switching element including at least one first signal means for particular signaling of the first or second mode of the first switching element, and the second switching element including at least one second signal means for particular signaling of the first or second mode of the second switching element, the second switching element being settable from the first mode to the second mode of the second switching element only when the first switching element is set from the first mode to the second mode of the first switching element;

wherein the second signal means indicates the first mode of the second switching element when the first switching element is in the second mode;

wherein when the second switching element is pressed without the first switching element being pressed for at least a predetermined period of time, the first signal means is activated intermittently.

10. An operating device for a power tool, the operating device comprising:

at least one first and second switching element, the first switching element being settable to a first and a second mode of the first switching element, and the second switching element being settable to a first and a second mode of the second switching element, the first switching element including at least one first signal means for particular signaling of the first or second mode of the first switching element, and the second switching element including at least one second signal means for particular signaling of the first or second mode of the second switching element, the second switching element being settable from the first mode to the second mode of the second switching element only when the first switching element is set from the first mode to the second mode of the first switching element;

wherein the second signal means indicates the first mode of the second switching element when the first switching element is in the second mode;

wherein after the first switching element has been pressed for longer than a predetermined period of time, the first signal means is deactivated and the second signal means is activated for a predetermined second period of time.

* * * * *